US011603604B2

(12) United States Patent
Park et al.

(10) Patent No.: US 11,603,604 B2
(45) Date of Patent: Mar. 14, 2023

(54) SPINNING PACK FOR MANUFACTURING HIGH STRENGTH YARN, AND YARN MANUFACTURING APPARATUS AND METHOD

(71) Applicant: KOLON INDUSTRIES, INC., Seoul (KR)

(72) Inventors: Sung Ho Park, Seoul (KR); Il Chung, Seoul (KR); Ki Sub Lim, Seoul (KR)

(73) Assignee: KOLON INDUSTRIES, INC., Seoul (KR)

( * ) Notice: Subject to any disclaimer, the term of this patent is extended or adjusted under 35 U.S.C. 154(b) by 283 days.

(21) Appl. No.: 16/977,659

(22) PCT Filed: Mar. 25, 2019

(86) PCT No.: PCT/KR2019/003445
§ 371 (c)(1),
(2) Date: Sep. 2, 2020

(87) PCT Pub. No.: WO2019/190141
PCT Pub. Date: Oct. 3, 2019

(65) Prior Publication Data

US 2020/0392646 A1 Dec. 17, 2020

(30) Foreign Application Priority Data

Mar. 29, 2018 (KR) ..... 10-2018-0036677

(51) Int. Cl.
*D01D 5/12* (2006.01)
*D01D 5/16* (2006.01)
(Continued)

(52) U.S. Cl.
CPC ..... *D01D 4/02* (2013.01); *D01D 5/084* (2013.01); *D01D 5/088* (2013.01); *D01F 6/62* (2013.01);
(Continued)

(58) Field of Classification Search
CPC ..... D01D 4/02; D01D 5/088; D01D 5/12; D01D 5/16; D01D 7/00; D01D 13/00;
(Continued)

(56) References Cited

U.S. PATENT DOCUMENTS 3,881,850 A * 5/1975 Stockbridge ..... D01D 13/00 425/382.2
4,264,555 A 4/1981 Lang
(Continued)

FOREIGN PATENT DOCUMENTS

CA 2438445 A1 6/2004
CN 1124509 A 6/1996
(Continued)

OTHER PUBLICATIONS

Abstract of JP-55045823-A (published on Mar. 31, 1980).*
(Continued)

*Primary Examiner* — Leo B Tentoni
(74) *Attorney, Agent, or Firm* — Harvest IP Law LLP

(57) ABSTRACT

One embodiment of the present disclosure provides a spinning pack, a yarn manufacturing apparatus including the spinning pack, a yarn manufacturing method using the yarn manufacturing apparatus, and yarn manufactured by the manufacturing method. The spinning pack includes a spinneret having a nozzle unit, a heating unit for heating the nozzle unit, a pack body surrounding at least a part of the spinneret, and a spinning block surrounding the pack body, wherein the spinneret includes a first surface which defines a storage space while facing at least one surface of the spinning block, and a second surface facing the first surface, wherein the nozzle unit includes a plurality of discharge holes and protrudes from the second surface; and wherein the heating unit is disposed at the outer side of the nozzle unit.

13 Claims, 8 Drawing Sheets

(51) Int. Cl.

| | |
|---|---|
| ***D01D 7/00*** | (2006.01) |
| ***D01D 13/00*** | (2006.01) |
| ***D01D 13/02*** | (2006.01) |
| ***D01D 4/02*** | (2006.01) |
| ***D01D 5/084*** | (2006.01) |
| ***D01D 5/088*** | (2006.01) |
| ***D01F 6/62*** | (2006.01) |
| ***D02G 3/48*** | (2006.01) |

(52) U.S. Cl.
CPC ..... *D02G 3/48* (2013.01); *D10B 2331/04* (2013.01); *D10B 2505/022* (2013.01)

(58) Field of Classification Search
CPC . D01D 13/02; D01F 6/62; D02G 3/48; D10B 2331/04; D10B 2505/022
USPC ..... 264/103, 210.8, 211.12, 211.14, 331.21; 425/66, 72.2, 378.2, 382.2, 464
See application file for complete search history.

(56) References Cited

U.S. PATENT DOCUMENTS

| | | | | |
|---|---|---|---|---|
| 4,867,936 | A * | 9/1989 | Buyalos | D01F 6/62 264/210.8 X |
| 4,927,586 | A * | 5/1990 | Smook | D01D 4/02 264/210.8 |
| 5,472,781 | A * | 12/1995 | Kim | D01F 6/62 428/364 |
| 6,284,174 | B1 | 9/2001 | Ueda et al. | |
| 2009/0221206 | A1* | 9/2009 | Gerking | D01D 5/14 425/72.2 |
| 2011/0020628 | A1* | 1/2011 | Fukudome | C08G 69/28 264/103 X |
| 2011/0076907 | A1 | 3/2011 | Glew et al. | |
| 2018/0051392 | A1 | 2/2018 | Hahm | |

FOREIGN PATENT DOCUMENTS

| | | | | |
|---|---|---|---|---|
| CN | 102191567 | A | 9/2011 | |
| CN | 107429432 | A | 12/2017 | |
| DE | 2234615 | A1 | 2/1974 | |
| EP | 2377977 | A1 | 10/2011 | |
| GB | 1058782 | A * | 2/1967 | C03B 37/08 |
| JP | 48028964 | B1 | 9/1973 | |
| JP | 55045823 | A * | 3/1980 | D01D 4/02 |
| JP | 60224806 | A | 11/1985 | |
| JP | 60259610 | A | 12/1985 | |
| JP | S61194204 | A | 8/1986 | |
| JP | 11-350236 | A | 12/1999 | |
| JP | 2000345424 | A | 12/2000 | |
| KR | 10-2015-0104475 | A | 9/2015 | |
| KR | 101632636 | B1 | 6/2016 | |
| KR | 10-1693313 | B1 | 1/2017 | |
| KR | 10-2017-0088148 | A | 8/2017 | |
| KR | 10-2017-0088151 | A | 8/2017 | |
| KR | 10-2017-0088154 | A | 8/2017 | |
| KR | 10-2017-0090636 | A | 8/2017 | |
| KR | 10-2017-0124293 | A | 11/2017 | |
| KR | 10-2018-0000148 | A | 1/2018 | |
| KR | 10-2018-0088207 | A | 8/2018 | |
| WO | 2016144105 | A1 | 9/2016 | |
| WO | 2017191916 | A1 | 11/2017 | |

OTHER PUBLICATIONS

EP Search Report dated Oct. 5, 2021.
Chemical Fibers International 57 (4) 178-183, (2007).
Notice of Allowance dated May 31, 2022 of the corresponding Japanese Patent Application.
International Search Report for PCT/KR2019/003445, dated Jul. 4, 2019 (PCT/ISA/210).

* cited by examiner

【FIG. 1】
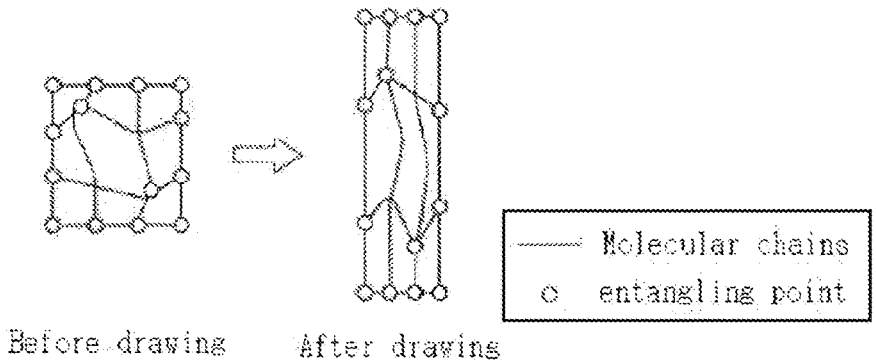
[ PRIOR ART ]

【FIG. 2】
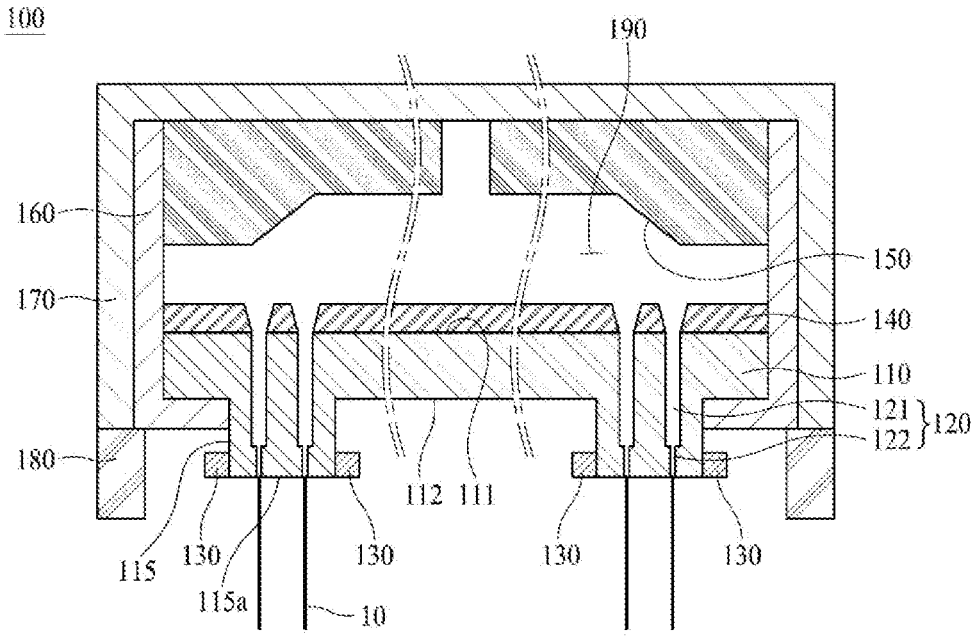

【FIG. 3】
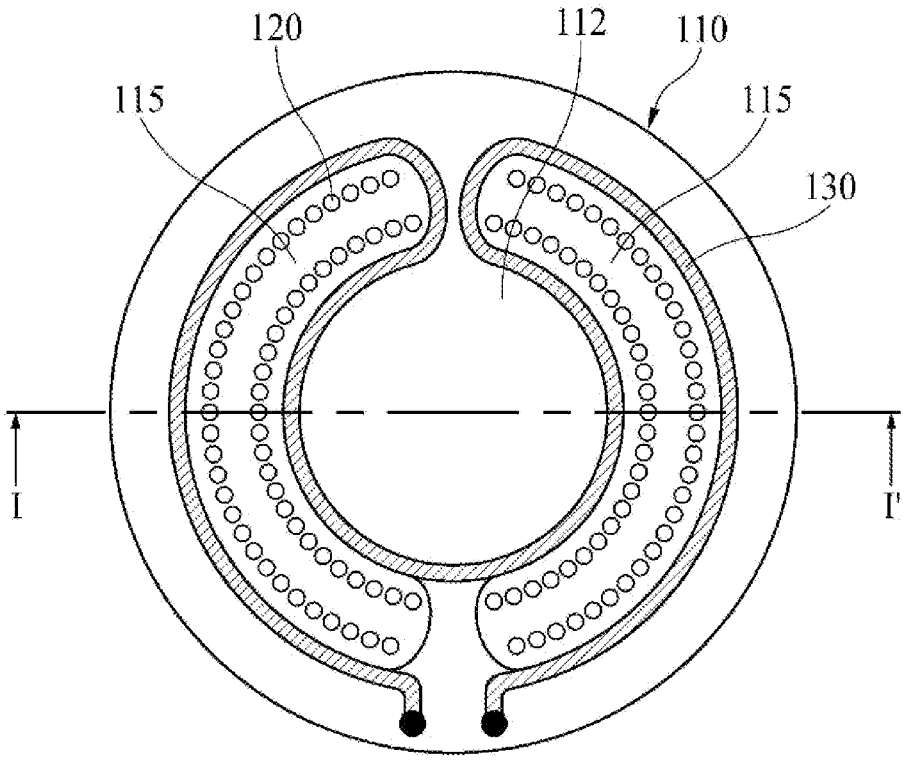

【FIG. 4】
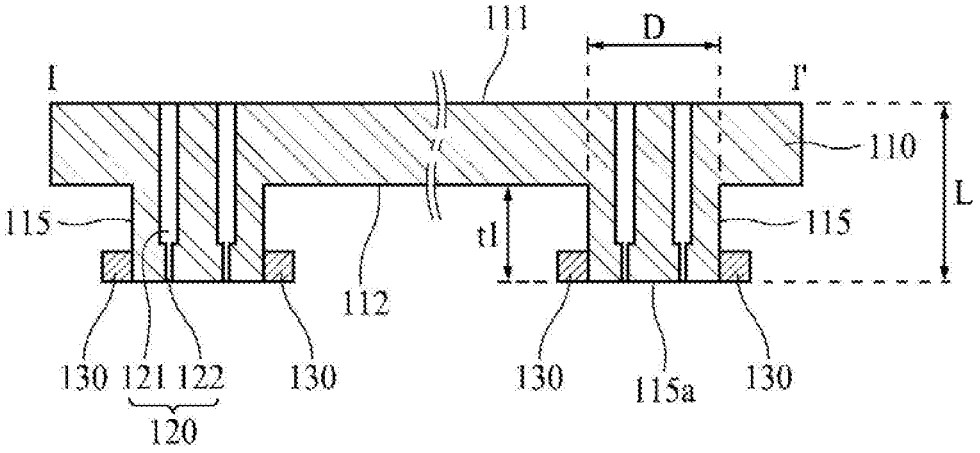

【FIG. 5】
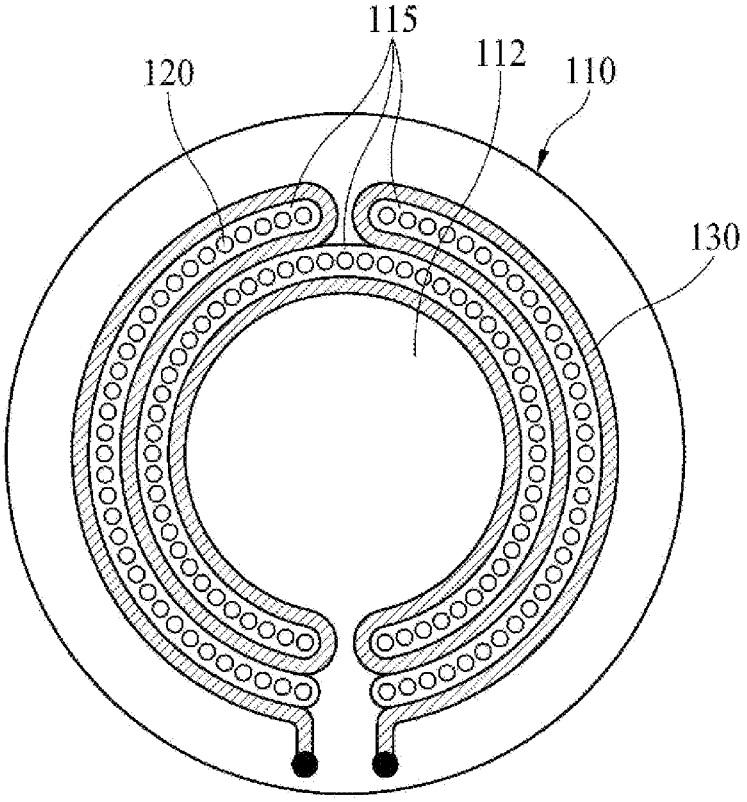

【FIG. 6】
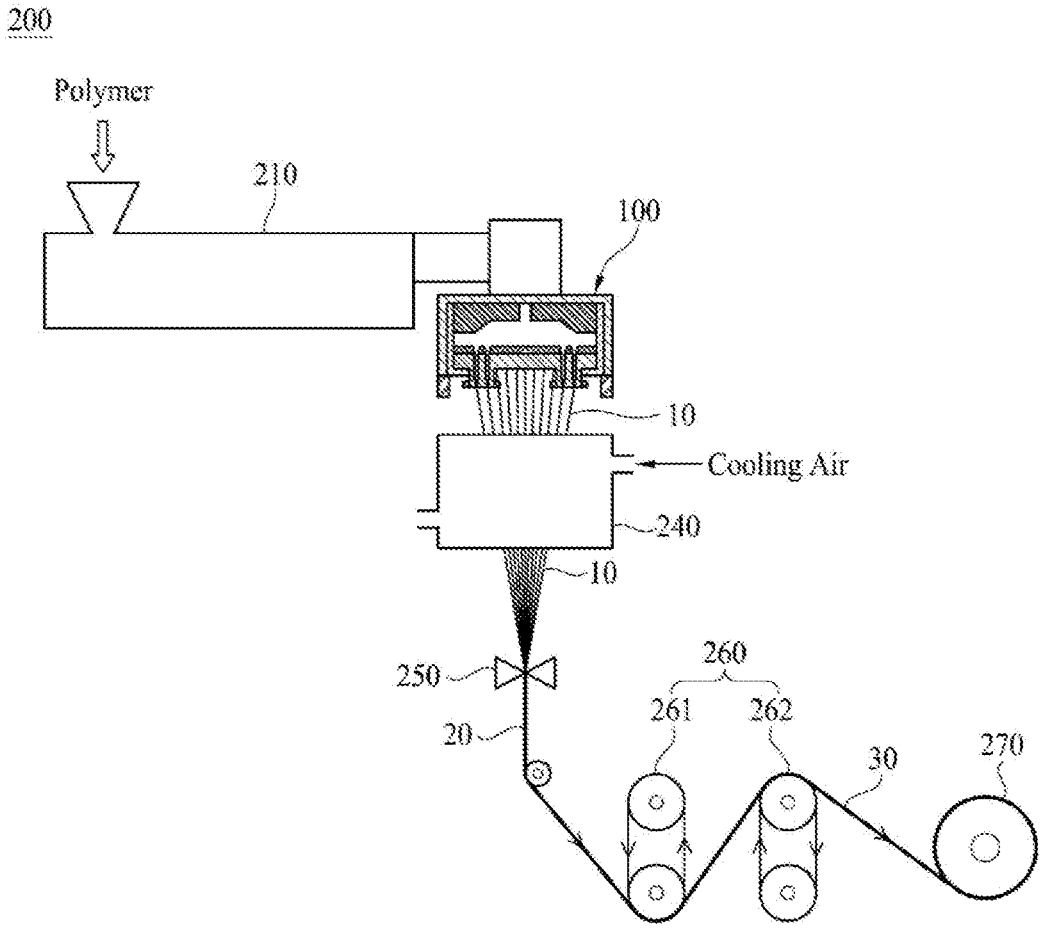

【FIG. 7】
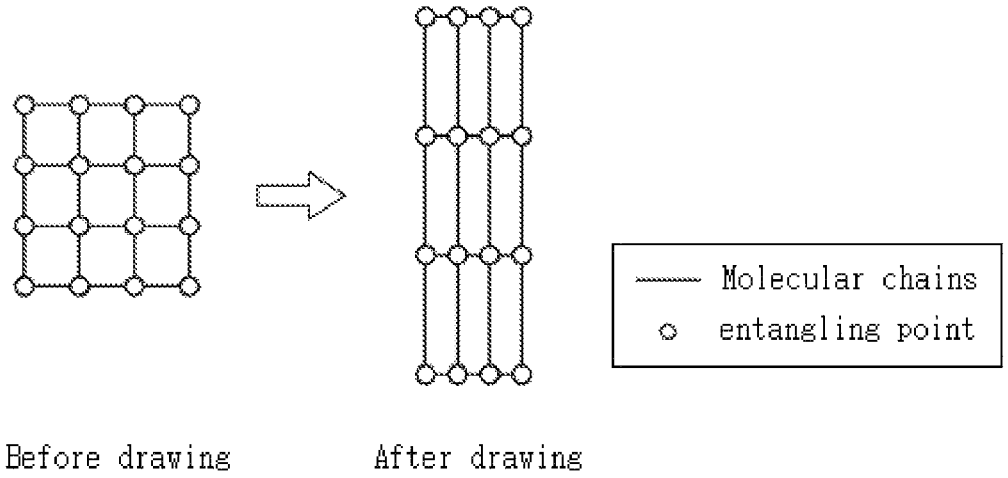

【FIG. 8】
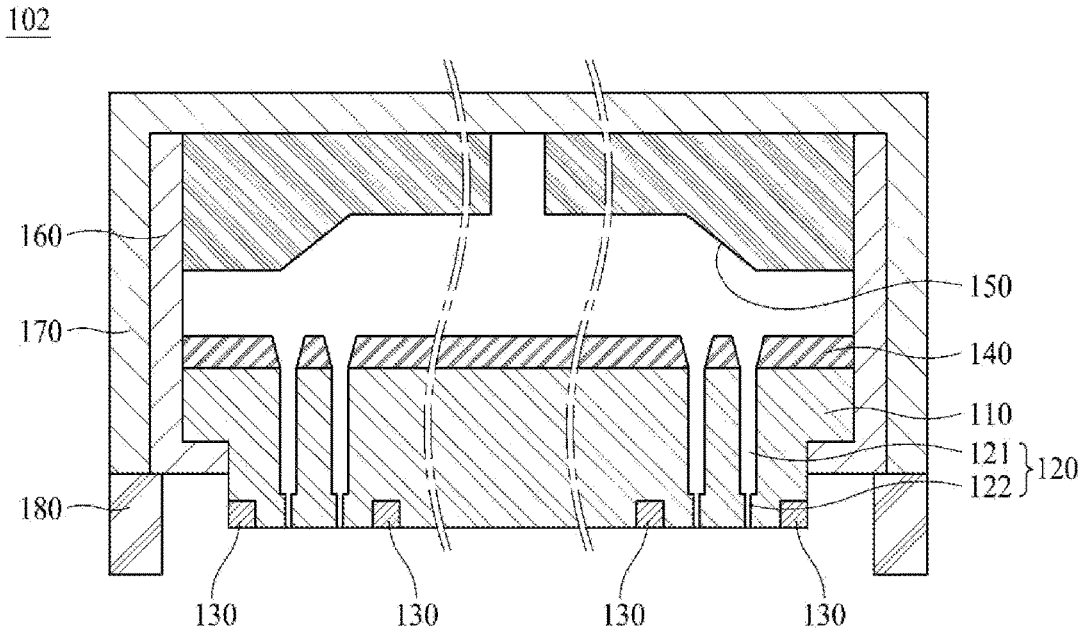

SPINNING PACK FOR MANUFACTURING HIGH STRENGTH YARN, AND YARN MANUFACTURING APPARATUS AND METHOD

CROSS REFERENCE TO RELATED APPLICATIONS

This application is a National Stage of International Application No. PCT/KR2019/003445 filed Mar. 25, 2019, claiming priority based on Korean Patent Application No. 10-2018-0036677 filed Mar. 29, 2018.

TECHNICAL FIELD

The present disclosure relates to a spinning pack for manufacturing a high strength yarn, and an apparatus and method for manufacturing the yarn. More specifically, the present disclosure relates to a spinning pack for manufacturing a polyester yarn having high strength, a polyester yarn manufacturing apparatus including the spinning pack, a method for manufacturing the polyester yarn, a polyester yarn manufactured by the manufacturing method, and a tire cord including the polyester yarn.

BACKGROUND ART

Several types of research have been continuously performed on improving the mechanical properties, for example, tensile strength, intermediate elongation, breaking elongation, and the like, of industrial yarns such as polyester yarns used for manufacturing tire cords, airbags, and the like.

A polyester yarn, which is a type of industrial yarn, can be generally manufactured by melting a polyester chip, spinning molten polyester using a spinneret, cooling semi-solidified state filaments formed by spinning the polyester, converging the cooled filaments to form a multifilament, drawing the multifilament and winding the drawn multifilament.

In order to improve the mechanical properties of such polyester yarn, it is necessary to maximize a draw ratio and a degree of orientation. However, in order to increase the draw ratio, low-speed spinning is required, while the low-speed spinning reduces the degree of orientation of fibers. Thus, since the draw ratio and the degree of orientation have a type of trade-off relationship, it is not easy to improve both the draw ratio and the degree of orientation.

Due to the degree of orientation and the draw ratio having a trade-off relationship, if the degree of orientation is set to a certain level or more under high-speed spinning conditions, the draw ratio may not be set to a certain level or more. Therefore, in order to manufacture a high-strength yarn without interference of the degree of orientation, it is necessary to adjust the draw ratio to a certain level or more.

Meanwhile, as a plurality of semi-solidified state filaments formed while the molten polyester is discharged from a spinneret may be heated or cooled, the molecular alignment state may be slightly modified (see FIG. 1). If the molecular alignment of the plurality of filaments immediately before drawing is irregular ("before drawing" on the left side in FIG. 1), the drawability becomes low. As a result, there is no choice but to reduce the degree of strength development under a predetermined draw ratio. Therefore, in order to improve the drawability, research has been conducted to stabilize the molecular alignment of a plurality of filaments formed while being discharged from the spinneret.

As a method for stabilizing the molecular alignment of filaments, there is a method of laser heating a plurality of filaments directly under the spinneret nozzle. The heating method using a laser has a feature of heating a specific portion of the plurality of filaments at a high temperature, but there is a problem that it is difficult to uniformly heat tens to tens of thousands of filaments simultaneously by applying to a commercial spinning nozzle having tens to tens of thousands of spinning holes. In addition, since the laser heating device is expensive, there is a difficulty in that the cost of operating the equipment is high.

DETAILED DESCRIPTION OF THE INVENTION

Technical Problem

Therefore, the present disclosure is intended to provide a yarn manufacturing apparatus and method capable of solving the limitations and disadvantages of the related art as described above.

An aspect of the present disclosure is to provide a spinning pack that can be used for manufacturing high strength yarns.

Another aspect of the present disclosure is to provide a yarn manufacturing apparatus capable of manufacturing high strength yarns, comprising the spinning pack.

Further another aspect of the present disclosure is to provide a method for manufacturing a high strength yarn using the yarn manufacturing apparatus.

Yet another aspect of the present disclosure is to provide a yarn manufactured by the manufacturing method, and a tire cord including the yarn.

In addition to the aspects of the invention described above, other features and advantages of the present disclosure will be set forth in part in the description which follows, and in part will become apparent to those having ordinary skill in the art upon examination of the following description.

Technical Solution

In order to achieve the above objects, according to an embodiment of the present disclosure, there is provided a spinning pack comprising: a spinneret having a nozzle unit, a heating unit for heating the nozzle unit, a pack body surrounding at least a part of the spinneret, and a spinning block surrounding the pack body, wherein the spinneret includes a first surface which defines a storage space while facing at least one surface of the spinning block, and a second surface facing the first surface, wherein the nozzle unit includes a plurality of discharge holes and protrudes from the second surface, and wherein the heating unit is disposed at the outer side of the nozzle unit.

The heating unit is disposed between the second surface and the end part of the nozzle unit.

The heating unit is in contact with the second surface or is spaced apart from the second surface at an interval of 20 mm or less from the second surface.

The heating unit includes a heating wire.

The heating unit heats the nozzle unit at a temperature of 400 to 600° C.

The spinning pack further includes a heater disposed in the spinning block.

According to another embodiment of the present disclosure, there is provided a yarn manufacturing apparatus comprising: a spinneret having a nozzle unit for discharging molten polymer, a heating unit for heating the nozzle unit, and a cooling unit disposed in the nozzle unit side of the spinneret and for cooling a plurality of filaments formed by discharging the molten polymer from the nozzle unit, wherein the spinneret includes a first surface and a second surface facing the first surface, and the second surface directs toward the cooling unit, wherein the nozzle unit includes a plurality of discharge holes and protrudes from the second surface, and wherein the heating unit is disposed at the outer side of the nozzle unit.

The yarn manufacturing apparatus further comprises a converging unit for converging the plurality of cooled filaments to form a multi-filament, a drawing unit for drawing the multi-filament, and a winder for winding the drawn multifilament.

According to another embodiment of the present disclosure, there is provided a yarn manufacturing method comprising the steps of: discharging a molten polymer using a spinning pack to form a plurality of filaments, cooling the plurality of filaments using a cooling unit, converging the plurality of filaments to form a multi-filament, drawing the multi-filament, and winding the drawn multi-filament, wherein the spinning pack includes a spinneret having a nozzle unit, a heating unit for heating the nozzle unit, a pack body surrounding at least a part of the spinneret, and a spinning block surrounding the pack body, wherein the spinneret includes a first surface which defines a storage space while facing at least one surface of the spinning block, and a second surface facing the first surface, wherein the nozzle unit includes a plurality of discharge holes and protrudes from the second surface, and wherein the heating unit is disposed at the outer side of the nozzle unit.

The heating unit heats the nozzle unit at a temperature of 400 to 600° C.

The molten polymer is spun at a speed of 500 to 4000 m/min.

The multifilament is drawn at a draw ratio of 2 to 4.

The molten polymer includes a polyester polymer, and the yarn is a polyester yarn.

Another embodiment of the present disclosure provides a yarn manufactured by the above manufacturing method.

The yarn has a tensile strength of 8.5 g/d or more.

Another embodiment of the present disclosure provides a tire cord including the yarn.

The tire cord has a tensile strength of 7.8 g/d or more.

The tire cord has a strength retention rate of 88% or more.

The above general description of the invention is only for illustrating or describing the invention, and it is not intended to limit the scope of the invention.

Advantageous Effects

The spinning pack according to an embodiment of the present disclosure includes a nozzle unit that is protruded from the second surface of the spinneret, and a heating unit for heating the nozzle unit, wherein the heating unit effectively heats the nozzle unit, so that the filament spun through the nozzle unit can have a uniform molecular alignment. Also, since the heating unit is exposed, the heat generated by the heating unit does not affect any part other than the nozzle unit, and since the protruding nozzle unit is heated only by the heating unit, it is advantageous for controlling the temperature of the nozzle unit.

Therefore, since the polymer and filament are not affected by unnecessary heat, the physical properties of the filament are not deteriorated, so that the filament has excellent physical properties, and yarn including such filaments may also have excellent physical properties. Further, excellent reproducibility can be achieved in the production of the yarn.

In addition, since the heating unit is disposed around the protruding nozzle unit, the heating unit can be easily installed and removed, and the manufacturing costs can be reduced.

BRIEF DESCRIPTION OF THE DRAWINGS

The accompanying drawing is given to aid in understanding of the present disclosure and to construct a part of the detailed description, is an illustrative embodiment of the present disclosure and explains principles of the present disclosure, in which:

FIG. 1 is a schematic view of the molecular structure of a conventional filament immediately before and after drawing.

FIG. 2 is a schematic cross-sectional view of a spinning pack according to an embodiment of the present disclosure.

FIG. 3 is a plan view of a second surface and a heating unit of a spinneret according to an embodiment of the present disclosure.

FIG. 4 is a cross-sectional view taken along line I-I' of FIG. 3.

FIG. 5 is a plan view of a second surface and a heating unit of a spinneret according to another embodiment of the present disclosure.

FIG. 6 is a schematic diagram of a yarn manufacturing apparatus according to another embodiment of the present disclosure.

FIG. 7 is a schematic diagram of the molecular structure of the polyester filament produced according to another embodiment of the present disclosure immediately before and after drawing.

FIG. 8 is a schematic cross-sectional view of a spinning pack according to a comparative example.

DETAILED DESCRIPTION OF THE EMBODIMENTS

Hereinafter, embodiments of the present disclosure will be described in detail with reference to the accompanying drawings.

It will be obvious to those skilled in the art that various modifications and variations of the present disclosure can be made without departing from the technical spirit and scope of the present disclosure. Accordingly, the present disclosure includes both modifications and variations that fall within the scope of the invention and its equivalents as set forth in the claims.

Hereinafter, the spinning pack 100 according to one embodiment of the present disclosure will be specifically described with reference to FIGS. 2 to 4.

FIG. 2 is a schematic cross-sectional view of a spinning pack 100 according to an embodiment of the present disclosure. FIG. 3 is a plan view of a second surface 112 and a heating unit 130 of a spinneret 110 according to an embodiment of the present disclosure. FIG. 4 is a cross-sectional view taken along line I-I' of FIG. 3.

The spinning pack 100 according to an embodiment of the present disclosure includes a spinneret 110, a heating unit 130, a pack body 160, and a spinning block 170. Referring to FIG. 2, the spinning pack 100 may further include a heater 180 disposed in the spinning block 170.

Referring to FIGS. 2 to 4, the spinneret 110 includes a first surface 111 which defines a storage space 190 while facing at least one surface of the spinning block 170, and a second surface 112 facing the first surface 111. Molten polymer may be stored in the storage space 190 defined by the spinning block 170 and the first surface 111 of the spinneret 110. Further, the spinneret 110 has a nozzle unit 115. The nozzle unit 115 has a plurality of discharge holes 120. The discharge hole 120 may include a main hole 121 and a tip part 122. The molten polymer is discharged through the plurality of discharge holes 120 formed in the nozzle unit 115. Specifically, the molten polymer is discharged after passing through the discharge hole 120.

According to an embodiment of the present disclosure, the nozzle unit 115 protrudes from the second surface 112. For example, the nozzle unit 115 may protrude from the second surface 112 by about 5 to 100 mm. That is, the nozzle unit 115 may have a protruding length t1 of about 5 to 100 mm. Here, the protruding length t1 of the nozzle unit 115 means the length that the nozzle unit 115 projects from the second surface 112 of the spinneret 110 (see FIG. 4).

The heating unit 130 heats the nozzle unit 115. As the heating unit 130 heats the nozzle unit 115, the molecular alignment of the filament 10 discharged through the discharge hole 120 of the nozzle unit 115 may be stabilized.

Referring to FIG. 3, a heating units 130 is disposed on both sides of a plurality of discharge holes 120 arranged concentrically in two rows.

More specifically, according to an embodiment of the present disclosure, the heating unit 130 is disposed outside the nozzle unit 115 and heats the nozzle unit 115. Referring to FIGS. 2 and 4, the heating unit 130 may be disposed in a shape surrounding at least a portion of the protruding nozzle unit 115. For example, the heating unit 130 is disposed between the second surface 112 of the spinneret 110 and the end part 115*a* of the nozzle unit 115.

According to an embodiment of the present disclosure, the heating unit 130 has an interval of 20 mm or less from the second surface 112. Specifically, the heating unit 130 may be in contact with the second surface 112 or may be spaced apart from the second surface 112 at an interval of 20 mm or less from the second surface 112.

As shown in FIGS. 2 and 4, since the heating unit 130 is exposed from other components, the heat generated in the heating unit 130 heats only the nozzle unit 115, and does not affect other parts of the spinning pack 100. Further, since the nozzle unit 115 is protruded and heated only by the heating unit 130, it is easy to control the temperature of the nozzle unit 115. Since the filament 10 discharged through the discharge hole 120 of the nozzle unit 115 is not affected by unnecessary heat by other components other than the heating unit 130, it is easy to control the physical properties of the filament 10, and the filament 10 can have excellent physical properties. In addition, the reproducibility is improved in the production of the yarn 30.

Further, since the heating unit 130 is disposed around the protruding nozzle unit 115, it is easy to install and remove the heating unit 130.

Referring to FIG. 3, the heating unit 130 includes a heating wire. Here, the heating wire serves as a heating source. However, the heating source according to an embodiment of the present disclosure is not limited thereto. The heating unit 130 may have a dot shape or a rod shape, or may have other shapes. Further, the heating unit 130 may include a dot-shaped heating source or a rod-shaped heating source.

The heating unit 130 may be detachably mounted to the nozzle unit 115. For this purpose, means for binding the nozzle unit 115 and the heating unit 130, for example, although not shown in the drawing, bolt, bolt groove, hooking jaw, etc. are provided in the nozzle unit 115, the spinneret 110, or the heating unit 130.

The heating unit 130 may include a heating wire that generates heat by an electric current. Examples of such heating wire include an electric heating wire such as a nichrome wire, an iron chrome wire, and tungsten. The heating wire can generate heat, for example, at a temperature of 400 to 600° C. The heating unit 130 may be extended in a linear shape or a curved shape, and is arranged such that its extension direction is perpendicular to the discharge direction of the molten polymer.

According to an embodiment of the present disclosure, the heating unit 130 heats the nozzle unit 115 at a temperature of 400 to 600° C. Accordingly, the molecular alignment of the plurality of filaments 10 discharged through the plurality of discharge holes 120 provided in the nozzle unit 115 is stabilized. As the heating unit 130 heats the nozzle unit 115 at a temperature of 400 to 600° C., in particular, the molecular alignment of the filament made of polyester can be stabilized.

The spinning pack 100 according to an embodiment of the present disclosure may further include a pack body 160 surrounding at least a part of the spinneret 110. The pack body 160 stably supports the spinneret 110 and serves to maintain the temperature of the spinneret 110.

Further, the spinning pack 100 further includes a spinning block 170 surrounding the pack body 160. The spinning block 170 protects the spinneret 110 and the pack body 160. Referring to FIG. 2, a storage space 190 of the polymer melted by at least one surface of the spinning block 170 and the first surface 111 of the spinneret 100 may be defined. More specifically, the storage space 190 of the melted polymer is defined by the first surface 111 of the spinneret 110, the pack body 160 and the spinning block 170 is defined.

According to an embodiment of the present disclosure, the spinning pack 100 further includes a heater 180 disposed in the spinning block 170. The heater 180 heats the spinning block 170 and the pack body 160 so that the temperature of the molten polymer stored in the storage space 190 is kept constant.

The temperature of the pack body 160 may be maintained, for example, at 260 to 320° C. When the temperature of the pack body 160 is less than 260° C., the temperature of the polymer housed in the storage space 190 drops below the melting point and the polymer is solidified, and thus, spinning may be difficult. On the other hand, when the temperature of the pack body 160 exceeds 320° C., the physical properties of the yarn may be deteriorated due to the thermal decomposition of the polymer housed in the storage space 190.

Referring to FIG. 2, the spinning pack 100 may further include a distribution plate 150 and a micro channel plate 140 disposed inside the pack body 160.

FIG. 5 is a plan view of a second surface 112 and a heating unit 130 of a spinneret 110 according to another embodiment of the present disclosure.

Referring to FIG. 5, an arc-shaped nozzle unit 115 protrudes from the second surface 112 of the spinneret 110, and a plurality of discharge holes 120 are formed in the nozzle unit 115. The plurality of discharge holes 120 are arranged concentrically in two rows, and the heating unit 130 is disposed on both sides of each row of the discharge holes 120 arranged concentrically. Referring to FIG. 5, the heating unit 130 is disposed at the outer side of the nozzle unit 115.

Hereinafter, a yarn manufacturing apparatus 200 of a yarn according to another embodiment of the present disclosure will be described in detail with reference to FIG. 6. FIG. 6 is a schematic diagram of a yarn manufacturing apparatus 200 according to another embodiment of the present disclosure.

Referring to FIG. 6, the yarn manufacturing apparatus 200 according to another embodiment of the present disclosure includes an extruder 210, a spinning pack 100, a cooling unit 240, and a conversing unit 250, a drawing unit 260 and a winder 270.

The extruder 210 melts a polymer and transfers the melted polymer to the spinning pack 100. As the polymer, for example, a polyester polymer can be used. Hereinafter, for convenience of description, a yarn manufacturing apparatus 200 according to another embodiment of the present disclosure will be described while focusing on a polyester yarn manufacturing apparatus using a polyester polymer. However, the manufacturing apparatus 200 of the present disclosure is not used only for manufacturing polyester yarns, but can also be used for manufacturing other yarns known in the art.

The spinning pack 100 forms a plurality of filaments 10 by discharging molten polymer, for example, polyester polymer, transmitted from the extruder 210.

The spinning pack 100 has been previously described with reference to FIGS. 2 to 4.

Specifically, referring to FIG. 2, the spinning pack 100 includes a spinneret 110, a heating unit 130, a pack body 160, a spinning block 170 and a heater 180.

Referring to FIGS. 2 to 4, the spinneret 110 includes a nozzle unit 115 for discharging the molten polymer. The nozzle unit 115 has a plurality of discharge holes 120, and the molten polymer, for example, the molten polyester polymer, is discharged through a plurality of discharge holes 120. The discharge hole 120 is exposed through the end part 115*a* of the nozzle unit 115 provided in the spinneret 110. The end part 115*a* of the nozzle unit 115 is also referred to as a discharge surface. Further, the discharge hole 120 includes a main hole 121 and a tip part 122. By discharging the molten polyester polymer through the discharge hole 120, the filament 10 is spun.

Referring to FIG. 3, the plurality of discharge holes 120 are arranged concentrically in the nozzle unit 115 protruding from the second surface 112 of the spinneret 110. However, one embodiment of the present disclosure is not limited thereto, and the discharge hole 120 may be arranged in other shapes.

The heating unit 130 is disposed at the outer side of the nozzle unit 115 and heats the nozzle unit 115. As the heating unit 130 heats the nozzle unit 115, the molecular alignment of the plurality of filaments 10 discharged through the discharge hole 120 of the nozzle unit 115 can be stabilized.

The shape of the heating unit 130 is not particularly limited. The heating unit 130 may be formed in a circular shape, a semi-circular shape, an arc shape, an S-shape, a linear shape, a W-shape or the like. The heating unit 130 may include a heating wire. For example, the heating unit 130 may be formed of a heating wire.

Referring to FIG. 3, the heating unit 130 has a shape in which semi-circular lines are connected to each other to form a curved line. However, another embodiment of the present disclosure is not limited thereto, and the heating unit 130 can be made in various shapes.

When the plurality of filaments 10 formed by discharging the melted polyester resin from the plurality of discharge holes 120 of the spinneret 110 move to the cooling unit 240, the heating unit 130 is arranged so as not to hinder the movement of the plurality of filaments 10*m*.

According to one embodiment of the present disclosure, the heating unit 130 is disposed sufficiently close to the discharge hole. Thereby, a sufficient heat can be instantaneously applied to the plurality of filaments 10 in such a manner that the molecular alignment of the polyesters aligned by the die swell phenomenon can be fixed as it is. As a result, the drawability of the filament 10 and the multi-filament 20 can be improved.

As shown in FIGS. 2 and 4, since the heating unit 130 is exposed from other components, the heat generated by the heating unit 130 does not affect other parts of the spinning pack 100. Further, since the nozzle unit 15 is protruded and heated only by the heating unit 130, it is easy to control the temperature of the nozzle unit 115. Since the filament 10 discharged through the discharge hole 120 of the nozzle unit 115 is not affected by unnecessary heat by other components other than the heating unit 130, it is easy to control the physical properties of the filament 10, and the filament 10 can have excellent physical properties. In addition, the reproducibility is improved in the production of the yarn 30.

Further, since the heating unit 130 is disposed around the protruding nozzle unit 115, the heating unit 130 can be easily installed and removed, and the yarn manufacturing cost can be reduced.

The heating unit 130 may have a temperature of 400 to 600° C. The nozzle unit 115 may be heated to a temperature of 400 to 600° C. by the heating unit 130.

Referring to FIG. 6, the yarn manufacturing apparatus 200 according to an embodiment of the present disclosure includes a pack body 160 surrounding at least a part of the spinneret 110. The pack body 160 is maintained at 260 to 320° C. If the temperature of the pack body 160 is less than 260° C., the temperature of the polyester polymer drops below the melting point and the polymer is solidified, and thus, spinning may be difficult. On the other hand, when the temperature of the pack body 160 exceeds 320° C., the physical properties of the polyester yarn may be deteriorated due to the thermal decomposition of the polyester polymer.

According to another embodiment of the present disclosure, the nozzle unit 115 may protrude from the pack body 160 by 5 to 100 mm. Thereby, the heating unit 130 can selectively heat only the nozzle unit 115.

Further, the heating unit 130 may be arranged to be spaced away from the second surface 112 of the spinneret by 0 to 20 mm, so that the filament 10 is heated during the process of discharging the polyester resin from the discharge hole 120 to form a filament 10. Here, the heating unit 130 being spaced away from the second surface 112 of the spinneret 110 by 0 mm means that the heating unit 130 is disposed in contact with the second surface 112 of the spinneret 110.

If the distance between the heating unit 130 and the second surface 112 of the spinneret 110 exceeds 20 mm, the filament 10 cannot be immediately heated when discharged from the discharge hole 120. As a result, the molecular alignment of the polyester polymer cannot be immediately fixed in that state.

The yarn manufacturing apparatus 200 according to an embodiment of the present disclosure may further include a distribution plate 150 and a microchannel plate 140 disposed inside the pack body 160, and may further include a spinning block 170 surrounding the pack body 160. A heater 180 may be disposed on one side of the spinning block 170. The heater 180 may heat the spinning block 170 or the pack body 160.

The cooling unit 240 cools the plurality of filaments 10.

The converging unit 250 converges the plurality of cooled filaments 10 to form a multifilament 20. The converging unit 250 may apply an oil agent to the multifilament 20. For this purpose, the converging unit 250 may further include an oil agent-imparting tool (not shown).

The drawing unit 260 draws the multifilament 20. Referring to FIG. 6, the drawing unit 260 includes a first godet roller 261 and a second godet roller 262. By stretching by the drawing unit 260, a drawn multifilament yarn 30 is formed.

The winder 270 winds the drawn multifilament.

Hereinafter, a method for manufacturing a yarn 30 according to another embodiment of the present disclosure will be described in detail with reference to FIG. 6. In the following, a method for manufacturing the yarn will be described while focusing on the polyester yarn.

First, the molten polymer is discharged using the spinning pack 100 to form a plurality of filaments 10. Here, the melted polymer may include a polyester polymer. In this case, the yarn 30 becomes a polyester yarn.

Specifically, a polyester chip having an intrinsic viscosity of 0.7 to 2.1 dl/g is introduced into the extruder 210 and melted to prepare a molten polyester polymer. At this time, polyethylene terephthalate (PET) may be used as a polyester chip. As such, the melted polyester polymer may include polyethylene terephthalate (PET).

The temperature of the polyester resin melted in the extruder 210 may be 290 to 310° C. When the temperature of the molten polyester polymer is less than 290° C., the polyester polymer is not melted uniformly and thus, spinning is difficult. When the temperature exceeds 310° C., not only the viscosity of the polyester polymer becomes excessively low, but also thermal decomposition by high temperature occurs, which may make it difficult to develop high strength.

As the molten polyester polymer is discharged through the spinneret 110 of the spinning pack 100, a plurality of filaments 10 are spun. The ratio of the nozzle length (L) and the nozzle diameter (D) of the spinneret 110, L/D may be 2 to 5. When L/D is less than 2, the spinnability is poor. Even when L/D exceeds 5, the pack pressure increases and the spinnability is poor. Here, the nozzle length L is defined as the distance between the first surface 111 of the spinneret 110 and the end part 115*a* of the nozzle unit 115, and the nozzle diameter D may be defined as the width of the nozzle unit 115 (see FIG. 4).

According to an embodiment of the present disclosure, the spinning speed is 500 to 4000 m/min. Thus, the molten polymer can be spun at a speed of 500 to 4000 m/min.

Immediately after being discharged from the spinneret 110, a plurality of filaments 10 are formed in a semi-solidified state while solidification of the polyester resin starts. At this time, as described above, the molecular alignment of the polyester polymer is regularly aligned by die swell phenomenon.

Since the nozzle unit 115 is heated by the heating unit 130, heating may be performed while the filament is formed. Referring to FIGS. 2 and 4, since the heating unit 130 is disposed at the tip part 122 of the discharge hole 120, the polyester polymer is heated while being spun into the filament 10.

The heating unit 130 heats the nozzle unit 115 at a temperature of 400 to 600° C. Thereby, the plurality of filaments 10 may be heated to a temperature of 400 to 600° C.

Specifically, the spinneret 110 is surrounded by a pack body 160 maintained at 260 to 320° C., and the nozzle unit 115 of the spinneret 110 protrudes from the pack body 160 by 5 to 100 mm. The end part 115*a* of the nozzle unit 115 through which the melted polyester polymer is discharged is heated by the heating unit 130, and heated to a temperature higher than the temperature of the pack body 160, for example, to a temperature of 400 to 600° C.

The plurality of filaments 10 spun from the spinning pack 100 is cooled at the cooling unit 240. In order to control the cooling process, cooling air having a predetermined temperature and speed is applied to a plurality of filaments 10. The temperature of the cooling air is about 10 to 50° C. Cooling of the filament 10 affects the final physical properties of the polyester yarn 30.

Next, a plurality of filaments 10 are converged to form a multifilament 20.

Specifically, the plurality of filaments 10 cooled and solidified in the cooling unit 240 are converged by the converging unit 250 to form a multifilament 20. The converging unit 250 may also apply an oil agent to the multifilament 20. For example, a step of forming the multifilament 20 and a step of applying an oil agent be simultaneously performed. The application of the oil agent may be performed through MO (Metered Oiling) or RO (Roller Oiling) systems.

Next, the multifilament 20 is drawn.

Specifically, the multifilament 20 formed by the converging process is drawn in the drawing unit 260. The drawing unit 260 may include first and second godet rollers 261 and 262.

The first godet roller 261 determines the spinning speed and the spinning draft ratio, and the draw ratio is determined by the ratio of the speed of the first godet roller 261 and the speed of the second godet roller 262. According to another embodiment of the present disclosure, the multifilament 20 may be drawn at a draw ratio of 2 to 4. Specifically, the draw ratio may be in the range of 2.0 to 3.5, and more specifically, in the range of 3.0 to 3.5.

According to another embodiment of the present disclosure, the spinning speed is 500 to 4000 m/min. Here, the spinning speed may be determined by the speed of the first godet roller 261. According to another embodiment of the present disclosure, the first godet roller 261 may rotate at a speed of 500 to 4000 m/min.

Optionally, a heating means (not shown) may be provided to the second godet roller 262 for heat treatment or heat setting of the drawn multifilament 20. By adjusting the number of winding on the second godet roller 262, the time that the multifilament 20 stays at the second godet roller 262 can be adjusted, through which appropriate heat treatment or heat setting for the drawn multifilament 20 may be performed.

FIG. 7 is a schematic diagram of the molecular structure of the polyester filament 20 produced according to another embodiment of the present disclosure immediately before and after drawing. The multifilament 20 according to another embodiment of the present disclosure has a regular molecular alignment both before and after drawing as illustrated in FIG. 7.

Next, the drawn multifilament 20 is wound. Specifically, the drawn and heat-treated multifilament 20 is wound by a winder 270, thereby completing the polyester yarn 30. At this time, the drawn and heat-treated multifilament 20 is also referred to as a polyester yarn 30.

Another embodiment of the present disclosure provides a yarn 30 manufactured by the above-mentioned method. According to another embodiment of the present disclosure, the yarn 30 is, for example, a polyester yarn.

The drawability of the multifilament 20 must be improved to produce a high strength polyester yarn. In order to improve the drawability of the multifilament, according to another embodiment of the present disclosure, heat treatment is performed by heating the nozzle unit 115. Specifically, heating is performed by the heating unit 130 disposed at the end of the nozzle unit 115, and the molecular alignment of the polyester is fixed in an aligned state, thereby forming a multifilament 20 having a regular molecular alignment.

Further, according to another embodiment of the present disclosure, the nozzle unit 115 is heated only by the heating unit 130 and the other heat is broken, thereby preventing the polyester resin from being degraded by unnecessary heat. Therefore, deterioration of the physical properties of the filaments and yarns made therefrom is prevented.

The polyester yarn 30 according to another embodiment of the present disclosure prepared as described above may include about 100 to 500 monofilaments having a fineness of 2 to 5 denier, and can have a tensile strength of 8.5 g/d or more.

Further, the polyester yarn 30 according to another embodiment of the present disclosure includes, for example, polyethylene terephthalate (PET), and is also called a PET yarn.

Another embodiment of the present disclosure provides a tire cord including the above-mentioned polyester yarn 30. The tire cord can be manufactured by a known method.

The tire cord according to another embodiment of the present disclosure has a tensile strength of 7.8 g/d or more. Further, according to another embodiment of the present disclosure, the tire cord has a strength retention rate of 88% or more.

Hereinafter, the present disclosure will be described in more detail with reference to examples and comparative Examples. However, the following examples and comparative examples are only to provide a better understanding of the invention, and the scope of the present disclosure is not limited thereby.

<Example 1 to 4> Production of Polyester Yarn

Using the yarn manufacturing apparatus 200 shown in FIG. 6 including the spinning pack 100 of FIG. 2, a polyester yarn 30 made of polyethylene terephthalate (PET) having a monofilament fineness of 4 denier (d) and a total fineness of 1000 denier (d) was manufactured.

Specifically, a PET chip having an intrinsic viscosity of 1.2 dl/g was melted to produce a molten polyester polymer, which was spun through a spinneret 10 (L/D=2.1/0.7, the number of discharge holes: 250) to produce a plurality of filaments 10. At this time, the nozzle unit 115 of the spinneret 10 was heated in the temperature range of 400 to 500° C. by using the heating unit 130 made of a heating wire, and strong heat was applied to the nozzle unit 115. Then, the melted polyester polymer was spun by a conventional method at a spinning speed of 1700 to 2700 mpm to produce a plurality of filaments 10, which were cooled and converged to produce an undrawn state multifilament 20 (undrawn yarn). The undrawn multifilament 20 thus produced was drawn at a draw ratio of 2.00 to 3.50 while passing through godet rollers 261 and 262, and wound to produce a polyester yarn 30 (drawn yarn). The draw ratio, temperature of the heating unit 130 and spinning speed applied at the time of producing the polyester yarns 30 according to Examples 1 to 4 are as shown in Table 1 below.

<Comparative Example 1 to 5> Production of Polyester Yarn

For comparison, a polyester yarn 30 was manufactured in the same manner as in Example 1, except that a yarn manufacturing apparatus including the spinning pack 102 shown in FIG. 8 was used, and this was designated as Comparative Examples 1 to 3. In addition, a polyester yarn 30 was produced in the same manner as in Example 1, except for using the yarn manufacturing apparatus including the spinning pack where the heating unit 130 was removed from the spinning pack 100 shown in FIG. 2, and this was designated as Comparative Examples 4 to 5. The draw ratio, temperature of the heating unit 130 and spinning speed applied at the time of producing the polyester yarns 30 according to Comparative Examples 1 to 5 are as shown in Table 1 below. However, in the case of Comparative Examples 1, 2, 4 and 5, the heating unit 130 was not disposed in the spinning pack.

TABLE 1

| | Draw ratio | Heating unit temperature (° C.) | Spinning speed (mpm) | Shape of spinning pack | Yarn quality |
|---|---|---|---|---|---|
| Example 1 | 3.50 | 400 | 1700 | FIG. 2 | ◎ |
| Example 2 | 2.00 | 400 | 2700 | FIG. 2 | ◎ |
| Example 3 | 3.50 | 500 | 1700 | FIG. 2 | ○ |
| Example 4 | 2.00 | 500 | 2700 | FIG. 2 | ◎ |
| Comparative Example 1 | 3.50 | Heat unit removed | 1700 | FIG. 8 | X |
| Comparative Example 2 | 2.00 | Heating unit removed | 2700 | FIG. 8 | ○ |
| Comparative Example 3 | 3.50 | 500 | 1700 | FIG. 8 | ◎ |
| Comparative Example 4 | 3.50 | Heating unit removed | 1700 | FIG. 2 (heating unit removed) | X |
| Comparative Example 5 | 2.00 | Heating unit removed | 2700 | FIG. 2 (heating unit removed) | X |

The yarn quality was evaluated as follows.

◎: Very excellent, ○: Excellent, Δ: Normal, X: Yarn production was impossible

In the case of Comparative Example 1, the yarn quality was very poor due to the high draw ratio and the production of yarn was substantially impossible. On the other hand, in the case of Comparative Examples 4 and 5, the spinning pack 100 of FIG. 2 from which the heating unit 130 was removed was used. However, although the nozzle portion 115 of the spinning pack was protruded, the heating unit 130 was not disposed in the nozzle unit 115, and the yarn quality was reduced during yarn production due to the cooling of the nozzle unit 115. As a result, even in Comparative Examples 4 and 5, production of yarn was substantially impossible.

Tensile strength, intermediate elongation (elongation at specific load: EASL) (at 4.5 kgf) and breaking elongation (%) of the polyester yarns produced in Examples 1 to 4 and Comparative Examples 2 to 3 were respectively measured, except for Comparative Examples 1, 4 and 5 where yarn production was substantially impossible.

Specifically, in accordance with the standard ASTM D885, the tensile strength (g/d), medium elongation at 4.5 kgf load (%) and breaking elongation (%) of the polyester yarn were measured using a universal tensile testing machine (Instron Engineering Corp, Canton, Mass.). The results are shown in Table 2 below.

TABLE 2

| | Tensile strength (g/d) | Intermediate elongation (at 4.5 kgf)(%) | Breaking elongation (%) |
|---|---|---|---|
| Example 1 | 10.1 | 5.0 | 12.1 |
| Example 2 | 8.6 | 6.0 | 13.4 |
| Example 3 | 10.4 | 4.9 | 11.0 |
| Example 4 | 8.8 | 5.9 | 13.5 |
| Comparative Example 2 | 9.1 | 5.6 | 12.8 |
| Comparative Example 3 | 10.3 (9.3) | 5.1 (5.7) | 10.9 (11.8) |

In Table 2, the results in parentheses "( )" represent the measured values for the yarns produced 12 hours after the heating of the nozzle unit 115 by the heating unit 130 was started.

Referring to Tables 1 and 2, the multifilament 20 manufactured according to Examples of the present disclosure can be drawn at a high draw ratio of 3.50 to form a yarn having excellent tensile strength (Examples 1 and 3).

Further, in Example 2, Example 4, and Comparative Example 2 having a low draw ratio of 2.0, the difference in tensile strength, intermediate strength, and breaking elongation was not large. Therefore, it can be confirmed that the multifilament 20 manufactured at a low elongation ratio according to Examples of the present disclosure may have at least the physical properties equal to or higher than those of the multifilament 20 according to Comparative Examples.

When mutually comparing Example 1, Example 3, Comparative Example 1, Comparative Example 3 and Comparative Example 5 to which relatively high draw ratio of 3.5 was applied under the spinning speed of 1700 mpm, in the case of Comparative Examples 1 and 5 in which the spinning process was performed with heating unit 130 removed, the quality of polyester yarn was so poor that production was impossible. On the other hand, in the case of Examples 1, 3 and Comparative Example 3, the drawability of the filaments was improved, so that even when a relatively high draw ratio of 3.5 was applied, it was possible to produce a yarn. The polyester yarn thus produced has a high tensile strength of 8.5 g/d or more.

In order to improve the tensile strength of polyester yarn to the level of 10 g/d by adjusting the draw ratio, it is generally known that a draw ratio of 3.0 or higher is required. According to the embodiments of the present disclosure, it can be confirmed that filaments and multifilaments that can be drawn at a draw ratio of 3.0 or more can be manufactured without reducing yarn quality.

On the other hand, referring to the measurement values 12 hours after heating the nozzle unit 115 shown in Comparative Example 3 and parentheses "( )", when the nozzle unit 115 is heated by the heating unit 130 for 12 hours or more, heat of the heating unit 130 is transferred to the spinneret 110, the pack body 160, and the spinning block 170, and the temperature of the spinning pack 100 is raised as a whole. This temperature rise causes a decrease in the physical properties of the polyester polymer, which leads to a phenomenon that the tensile strength of the polyester yarn decreases and the intermediate elongation and the breaking elongation increase. Further, when the heat generated in the heating unit 130 is transferred to the spinneret 110, the pack body 160 and the spinning block 170, the yarn manufacturing device including the spinning pack 100 is deteriorated, which causes a problem that the yarn manufacturing device is not used for a certain period of time or more. When comparing the initial measurement value (value outside the parentheses) of Comparative Example 3 with the measurement value (value inside the parentheses) for the yarn produced after 12 hours, it can be seen that there is a change in the physical properties of the yarn. Thus, in accordance with Comparative Example 3, reproducibility is reduced in the production of yarn.

In general, when the operation of the yarn manufacturing apparatus starts, the yarn manufacturing device is operated for as short as several days, or for as long as several weeks or months. At this time, the heating unit 130 is also operated, but the heat generated in the heating unit 130 becomes a variable, so that the temperature of the spinning pack 100 is not easily controlled, and the reproducibility is reduced in the production of yarn.

On the other hand, according to an embodiment of the present disclosure, the nozzle unit 115 is protruding, the heating unit 130 heats only the nozzle unit 115, and the heat does not affect the other parts of the spinning pack 100. Thus, the temperature of the spinning pack 100 can be easily controlled, and the reproducibility is excellent in the production of the yarn.

<Example 5 to 8 and Comparative Example 6 to 7> Manufacture of Tire Cord

Using the polyester yarns produced in Examples 1 to 4 and Comparative Examples 2 to 3, the tire cords of Examples 5 to 8 and Comparative Examples 6 to 7 were manufactured by the same method under the same conditions, respectively.

Specifically, two strands of the primary twisted yarn (Z-direction) having a twist number of 460 TPM were produced by using a polyester yarn, and then two strands of the primary twisted yarn were secondarily twisted (S-direction) with a twist number of 460 TPM to produce a plied yarn. The thus-produced plied yarn was passed through the resorcinol-formaldehyde-latex (RFL) adhesive solution and subjected to drying and heat treatment to complete the tire cord.

The strength, the intermediate elongation under a load of 4.5 kgf, the breaking elongation, the dry heat shrinkage, and the strength retention rate of the tire cords of Example 5 to 8 and Comparative Example 6 to 7 were measured and calculated by the following methods, respectively.

<Tensile Strength, Intermediate Elongation Under a Load of 4.5 kgf, and Breaking Elongation of the Tire Cord>

The tensile strength (g/d), the intermediate elongation (%) under a load of 4.5 kgf and the breaking elongation (%) of the tire cord were measured using an Instron universal tensile tester in accordance with the standard ASTM D885.

<Dry Heat Shrinkage of Tire Cord>

In accordance with the standard ASTM D4974-04, the initial length L1 of the sample with a load of 0.2 g/d applied and the length L2 of the sample after 2 minutes with a load of 0.2 g/d applied at 180° C. were respectively measured using a dry heat shrinkage tester (TESTRITE, model name: MK-V), and then the dry heat shrinkage (%) of the polyester yarn was calculated by the following Equation.

$$\text{Dry Heat Shrinkage (\%)}=[(L1-L2)/L1]\times 100$$

<Strength Retention Rate of Tire Cord>

The strength retention rate was calculated as the strength of the tire cord versus the strength of the yarn. That is, the strength retention rate was calculated by the following Equation.

Strength retention rate (%)=[Tire cord strength (g/d)/Yarn strength (g/d)]×100

The measurement results are shown in Table 3 below.

TABLE 3

| Condition | Tensile strength (g/d) | Intermediate elongation (at 4.5 kgf) (%) | Breaking elongation (%) | Dry heat shrinkage (%) | Strength retention rate (%) | Yarn |
|---|---|---|---|---|---|---|
| Example 5 | 9.0 | 4.0 | 12.9 | 3.7 | 89.1 | Example 1 |
| Example 6 | 7.9 | 4.1 | 14.5 | 3.0 | 91.8 | Example 2 |
| Example 7 | 9.2 | 4.0 | 13.0 | 3.9 | 88.4 | Example 3 |
| Example 8 | 8.1 | 4.0 | 14.2 | 3.2 | 92.0 | Example 4 |
| Comparative Example 6 | 8.1 | 4.1 | 14.3 | 3.2 | 89.0 | Comparative Example 2 |
| Comparative Example 7 | 9.2 (8.5) | 3.9 (4.2) | 12.9 (13.3) | 3.9 (3.6) | 89.3 (91.4) | Comparative Example 3 |

In Table 3, the results in parentheses "( )" represents the measured values of the tire cords which was manufactured using yarns produced 12 hours after the heating of the nozzle unit 115 by the heating unit 130 was started.

Referring to Table 3, the tire cord (Examples 5 to 8) made of a polyester yarn (Examples 1 to 4) produced according to embodiments of the present disclosure has excellent strength, intermediate elongation, and breaking elongation, dry heat shrinkage and strength retention rate.

In particular, the tire cord (Examples 5 to 8) made of polyester yarn (Examples 1 to 4) made according to the embodiments of the present disclosure has a strength retention rate of 88% or more.

On the other hand, referring to Comparative Example 7, it was confirmed that the tire cord (value in parentheses) manufactured using a polyester yarn produced after the nozzle unit 115 is heated by the heating unit 130 for at least 12 hours has low tensile strength and dry heat shrinkage, and also has high breaking elongation and strength retention rate, as compared with the tire cords (values outside parentheses) manufactured using initially manufactured yarn. Thus, referring to Comparative Example 5, since the physical properties of the tire cord change with the time when the yarn was manufactured, the reproducibility of the tire cord is not excellent.

DESCRIPTION OF REFERENCE NUMERALS

| | |
|---|---|
| 100: spinning pack | 110: spinneret |
| 112: second surface | 115: nozzle unit |
| 120: discharge hole | 130: heating unit |
| 140: microchannel plate | 150: distribution plate |
| 160: pack body | 170: spinning block |
| 180: heater | 190: storage space |
| 200: yarn manufacturing apparatus | 210: extruder |
| 240: cooling unit | 250: converging unit |
| 260: drawing unit | 261: first godet roller |
| 262: second godet roller | 270: winder |

The invention claimed is:

1. A spinning pack comprising:

a spinneret having a nozzle unit;

a heating unit for heating the nozzle unit;

a pack body surrounding at least a part of the spinneret; and a spinning block surrounding the pack body, wherein the spinneret includes a first surface which defines a storage space while facing at least one surface of the spinning block, and a second surface facing the first surface, wherein the nozzle unit includes a plurality of discharge holes and protrudes from the second surface, and wherein the heating unit contacts with a outer side of the nozzle unit and the heating unit is disposed at the outer side of the nozzle unit.

2. The spinning pack of claim 1, wherein the heating unit is disposed between the second surface and an end part of the nozzle unit.

3. The spinning pack of claim 1, wherein the heating unit is in contact with the second surface or is spaced apart from the second surface at an interval of 20 mm or less from the second surface.

4. The spinning pack of claim 1, wherein the heating unit includes a heating wire.

5. The spinning pack of claim 1, wherein the heating unit heats the nozzle unit at a temperature of 400 to 600° C.

6. The spinning pack of claim 1, further comprising a heater disposed on one side of the spinning block.

7. A yarn manufacturing apparatus comprising:

a spinneret having a nozzle unit for discharging molten polymer, a heating unit for heating the nozzle unit, and a cooling unit disposed in the nozzle unit side of the spinneret and for cooling the plurality of filaments formed by discharging a molten polymer from the nozzle unit, wherein the spinneret includes a first surface and a second surface facing the first surface, and the second surface directs toward the cooling unit, wherein the nozzle unit includes a plurality of discharge holes and protrudes from the second surface, and wherein the heating unit contacts with a outer side of the nozzle unit and the heating unit is disposed at the outer side of the nozzle unit.

8. The yarn manufacturing apparatus of claim 7, further comprising:

a converging unit for converging the plurality of cooled filaments to form a multi-filament, a drawing unit for drawing the multi-filament, and a winder for winding the drawn multifilament.

9. A yarn manufacturing method comprising the steps of:

discharging a molten polymer using a spinning pack to form a plurality of filaments;

cooling the plurality of filaments using a cooling unit;

converging the plurality of filaments to form a multi-filament;

drawing the multi-filament; and winding the drawn multi-filament, wherein the spinning pack includes:

a spinneret having a nozzle unit, a heating unit for heating the nozzle unit, a pack body surrounding at least a part of the spinneret, and a spinning block surrounding the pack body, wherein the spinneret includes a first surface which defines a storage space while facing at least one surface of the spinning block, and a second surface facing the first surface, wherein the nozzle unit includes a plurality of discharge holes and protrudes from the second surface, and wherein the heating unit contacts with a outer side of the nozzle unit and the heating unit is disposed at the outer side of the nozzle unit.

10. The yarn manufacturing method of claim 9, wherein the heating unit heats the nozzle unit at a temperature of 400 to 600° C.

11. The yarn manufacturing method of claim 9, wherein the molten polymer is spun at a speed of 500 to 4000 m/min.

12. The yarn manufacturing method of claim 9, wherein the multifilament is drawn at a draw ratio of 2 to 4.

13. The yarn manufacturing method of claim 9, wherein the molten polymer includes a polyester polymer, and the yarn is a polyester yarn.

* * * * *